US008040030B2

(12) United States Patent
Jonkers et al.

(10) Patent No.: US 8,040,030 B2
(45) Date of Patent: Oct. 18, 2011

(54) METHOD OF INCREASING THE CONVERSION EFFICIENCY OF AN EUV AND/OR SOFT X-RAY LAMP AND A CORRESPONDING APPARATUS

(75) Inventors: Jeroen Jonkers, Aachen (DE); Dominik Marcel Vaudrevange, Neuss (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 347 days.

(21) Appl. No.: 12/300,858

(22) PCT Filed: May 8, 2007

(86) PCT No.: PCT/IB2007/051716

§ 371 (c)(1), (2), (4) Date: Nov. 14, 2008

(87) PCT Pub. No.: WO2007/135587

PCT Pub. Date: Nov. 29, 2007

(65) Prior Publication Data

US 2009/0206268 A1 Aug. 20, 2009

(30) Foreign Application Priority Data

May 16, 2006 (EP) ..... 06113972

(51) Int. Cl.
*H01J 61/18* (2006.01)
*H01J 61/28* (2006.01)

(52) U.S. Cl. ..... 313/231.01; 313/231.31; 313/231.41; 313/231.51; 313/231.61; 313/231.71

(58) Field of Classification Search ..... 313/231.01, 313/231.31, 231.41, 231.51, 231.61, 231.71
See application file for complete search history.

(56) References Cited

U.S. PATENT DOCUMENTS

| | | | | |
|---|---|---|---|---|
| 6,084,198 | A | 7/2000 | Birx | |
| 2002/0094063 | A1 | 7/2002 | Nishimura et al. | |
| 2005/0072942 | A1 | 4/2005 | Barthod et al. | |
| 2005/0178985 | A1 * | 8/2005 | McGeoch | 250/504 R |

FOREIGN PATENT DOCUMENTS

| | | | |
|---|---|---|---|
| EP | 1401248 | A2 | 3/2004 |
| EP | 1460886 | A2 | 9/2004 |
| EP | 1530087 | A2 | 5/2005 |
| WO | 2005025280 | A2 | 3/2005 |
| WO | WO 2005025280 | A2 * | 3/2005 |
| WO | 2005060321 | A2 | 6/2005 |

* cited by examiner

*Primary Examiner* — Joseph L Williams
*Assistant Examiner* — Nathaniel Lee

(57) ABSTRACT

The present invention relates to a method of increasing the conversion efficiency of an EUV and/or soft X-ray lamp, in which a discharge plasma (8) emitting EUV radiation or soft X-rays is generated in a gaseous medium formed by an evaporated liquid material in a discharge space, said liquid material being provided on a surface in the discharge space and being at least partially evaporated by an energy beam (9). The invention also refers to a corresponding apparatus for producing EUV radiation and/or soft X-rays. In the method, a gas (11) composed of chemical elements having a lower mass number than chemical elements of the liquid material is supplied through at least one nozzle (10) in a directed manner to the discharge space and/or to the liquid material on a supply path to the discharge space in order to reduce the density of the evaporated liquid material in the discharge space. With the present method and corresponding apparatus the conversion efficiency of the lamp is increased.

17 Claims, 1 Drawing Sheet

METHOD OF INCREASING THE CONVERSION EFFICIENCY OF AN EUV AND/OR SOFT X-RAY LAMP AND A CORRESPONDING APPARATUS

FIELD OF THE INVENTION

The present invention relates to a method of increasing the conversion efficiency of an extreme ultraviolet (EUV) and/or soft X-ray lamp, in which a discharge plasma emitting EUV radiation and/or soft X-rays is generated in a gaseous medium formed by an evaporated liquid material in a discharge space, said liquid material being provided on a surface in the discharge space and being at least partially evaporated by an energy beam. The invention also relates to an apparatus for producing EUV radiation and/or soft X-rays by means of an electrically operated discharge, said apparatus comprising at least two electrodes arranged at a distance from one another to allow the generation of a plasma in a gaseous medium in a discharge space between said electrodes, a device for applying a liquid material to a surface in said discharge space, and an energy beam device adapted to direct an energy beam onto said surface, which energy beam evaporates said applied liquid material at least partially, thereby producing said gaseous medium.

BACKGROUND OF THE INVENTION

Radiation sources emitting EUV radiation and/or soft X-rays are in particular required in the field of EUV lithography. The radiation is emitted from a hot plasma produced by a pulsed current. The most powerful EUV lamps known up to now are operated with metal vapor to generate the required plasma. An example of such an EUV lamp is shown in WO2005/025280 A2. In this known EUV lamp, the metal vapor is produced from a metal melt which is applied to a surface in the discharge space between the electrodes and at least partially evaporated by an energy beam, in particular by a laser beam. In a preferred embodiment of this EUV lamp, the two electrodes are rotatably mounted, forming electrode wheels which are rotated during operation of the lamp. The electrode wheels, during rotation, dip into containers with the metal melt. A pulsed laser beam is directed directly to the surface of one of the electrodes in order to generate the metal vapor from the applied metal melt and ignite the electrical discharge. The metal vapor is heated by a current of some kA up to approximately 10 kA, so that the desired ionization stages are excited and radiation of the desired wavelength is emitted.

A common problem of known EUV and/or soft X-ray lamps is that the efficiency of the conversion of supplied electrical energy into EUV radiation and/or soft X-rays of a desired small bandwidth is low. In particular in the field of optical lithography for the semiconductor industry, EUV radiation around 13.5 nm within a 2% bandwidth is required.

SUMMARY OF THE INVENTION

It is an object of the present invention to provide a method of increasing the conversion efficiency of an EUV and/or soft X-ray lamp as well as an apparatus or lamp for producing EUV and/or soft X-ray radiation with an increased conversion efficiency.

This object is achieved with the method and apparatus of claims 1 and 6. Advantageous embodiments of the method and apparatus are subject of the sub-claims and are furthermore described in the following description and examples for carrying out the invention.

In the present method, a discharge plasma emitting EUV radiation and/or soft X-rays is generated in a gaseous medium formed by an evaporated liquid material in a discharge space, wherein said liquid material is provided on a surface in the discharge space and at least partially evaporated by an energy beam, in particular a laser beam. The method is characterized in that a gas composed of chemical elements having a lower mass number than chemical elements of the liquid material is supplied locally, through at least one nozzle, in a directed manner to the discharge space and/or to the liquid material on a supply path to the discharge space in order to reduce a density of the evaporated liquid material in the discharge space.

Due to the reduction in density of the evaporated liquid material, preferably a melted metal, by using elements which do not produce very much radiation, the conversion efficiency of the EUV and/or soft X-ray lamp can be increased. This is explained in the following by means of the example of melted tin as the liquid material, also called fuel. Using tin as fuel in the EUV lamp, EUV radiation within a 2% bandwidth around 13.5 nm can be generated. The whole emission spectrum of the tin vapor plasma, however, consists of the order of $10^6$ spectral lines. The plasma therefore also emits in a wavelength range which does not contribute to the desired EUV radiation. Furthermore, a significant part of the produced radiation does not leave the plasma but is absorbed inside the plasma. This results in a relative large contribution of radiation at longer wavelengths, outside of the bandwidth that can be used by common optical elements for collecting or deflecting the EUV radiation. By adding the gas according to the present method, however, part of the fuel is replaced by the lighter elements of the supplied gas. This reduces the absorption of the EUV radiation by the fuel and therefore increases the efficiency of the plasma. In this way, the total radiation losses of the plasma can be reduced, which will result in a higher plasma temperature. A hotter plasma produces more radiation at shorter wavelengths as required for EUV and/or soft X-ray lamps.

It is however not possible to supply the additional gas to the whole vacuum chamber of an EUV lamp, since for example oxygen as the preferred gas would significantly reduce the lifetime of the expensive optics of the lamp. In order to avoid this problem, according to the present method the gas is supplied only locally through at least one nozzle in a directed manner to the discharge space and/or to the liquid material on a supply path to the discharge space. Due to this local application of the gas close to the discharge space, a diffusion of higher amounts of this gas to optical components of the lamp can be avoided. Nevertheless, the supplied gas reduces the density of the fuel in the plasma, resulting in a higher conversion efficiency of the lamp. The nozzle can be arranged to directly supply the gas to the discharge space or to supply the gas to the liquid material so that the gas is transported by this liquid material to the discharge space. In the latter case, the gas is selected so as to be dissolved by or bonded to the liquid material.

The gas and liquid material (fuel) are further selected, based on the desired wavelength range for the EUV and/or soft X-ray emission, such that the desired increase of the conversion efficiency occurs in this wavelength range. This means that different combinations of fuel and gas must be used in order to increase the conversion efficiency of lamps for different wavelength ranges. In principle, gases of the first to third row of the periodic table of elements can be used.

The proposed apparatus comprises at least two electrodes arranged in a vacuum chamber at a distance from one another to allow the generation of a plasma in a gaseous medium between said electrodes, a device for applying a liquid material to a surface in the discharge space, and an energy beam device adapted to direct an energy beam onto said surface evaporating said applied liquid material at least partially, thereby producing said gaseous medium. The apparatus is characterized in that at least one nozzle for supply of a gas is arranged such in the apparatus that said gas is supplied locally in a directed manner to the discharge space and/or to the liquid material on a supply path to the discharge space in order to reduce a density of the evaporated liquid material in the discharge space.

In a preferred embodiment of the apparatus and the proposed method, an apparatus as disclosed in WO2005/025280 A2, which is included herein by reference, is used and provided with the one or several nozzles for the supply of the gas.

In the present description and claims, the word "comprising" does not exclude other elements or steps, and the use of "a" or "an" does not exclude a plurality. Also any reference signs in the claims shall not be construed as limiting the scope of these claims.

BRIEF DESCRIPTION OF THE DRAWINGS

An example of the present method and apparatus is described in the following with reference to the accompanying drawing, and should not be construed as limiting the scope of the claims. The FIGURE shows a schematic view of an EUV lamp according to the present invention.

DESCRIPTION OF PREFERRED EMBODIMENTS

Figure 1:
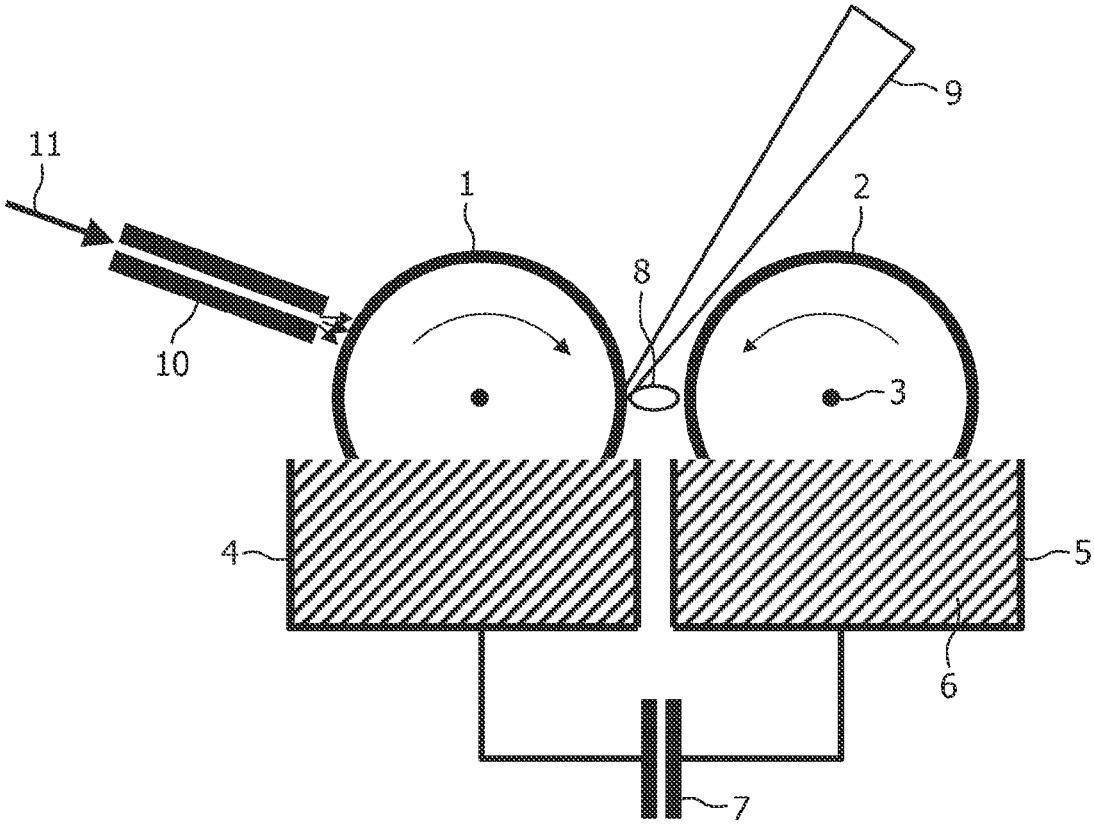

The FIGURE shows a schematic view of a part of the proposed lamp and also indicates the principle of the present method. The EUV lamp comprises two electrodes 1, 2 arranged in a vacuum chamber. The disc-shaped electrodes 1, 2 are rotatably mounted, i.e. they are rotated about rotational axes 3 during operation. During rotation, the electrodes 1, 2 partially dip into corresponding containers 4, 5. Each of these containers 4, 5 contains a metal melt 6, in the present case liquid tin. The metal melt 6 is kept at a temperature of approximately 300° C., i.e. slightly above the melting point of 230° C. of tin. The metal melt in the containers 4, 5 is maintained at the above operation temperature by a heating device or a cooling device (not shown in the FIGURE) connected to the containers. During rotation, the surface of the electrodes 1, 2 is wetted by the liquid metal so that a liquid metal film forms on said electrodes. The layer thickness of the liquid metal on the electrodes can be controlled by means of skimmers, not shown in the FIGURE. The current to the electrodes is supplied via the metal melt 6, which is connected to the capacitor bank 7 via an insulated feedthrough.

A laser pulse 9 is focused on one of the electrodes 1, 2 at the narrowest point between the two electrodes, as shown in the FIGURE. As a result, part of the metal film on the electrodes 1, 2 evaporates and bridges the electrode gap. This leads to a disruptive discharge at this point and a very high current from the capacitor bank 7. The current heats the metal vapor or fuel to such high temperatures that the latter is ionized and emits the desired EUV-radiation in a pinch plasma 8 in the discharge space between the two electrodes 1, 2.

A tiny nozzle 10 is arranged close to the first electrode 1 in order to supply a gas 11 composed of chemical elements with a smaller mass number than tin to the thin liquid tin film on the surface of the electrode 1. In the present example, the supplied gas is oxygen, which oxidizes the tin on the electrode wheel so that the oxygen ends up in the pinch. In this way, the total oxygen load of the lamp is small and the tin oxide is only produced on the electrode. Although only one nozzle 10 is shown in the present example, a second or even more nozzles can be arranged close to the first and second electrodes 1, 2 in the same manner. The nozzles 10 are placed very close to the surface of the electrode wheels, for example at a distance of 10 mm or less, in order to avoid diffusion of the oxygen to other components of the lamp.

First experiments showed that the addition of a small amount of oxygen during operation increases the conversion efficiency of this lamp from 2.0 to 2.3%.

LIST OF REFERENCE SIGNS

1 first electrode
2 second electrode
3 rotation axis
4 first container
5 second container
6 tin melt
7 capacitor bank
8 pinch plasma
9 laser pulse
10 gas nozzle
11 gas

The invention claimed is:

1. A method of increasing conversion efficiency of lamp, in which a discharge plasma emitting EUV radiation and soft X-rays is generated in a gaseous medium formed by an evaporated liquid material in a discharge space, said liquid material being provided on a surface in the discharge space and being at least partially evaporated by an energy beam, comprising supplying a gas composed of chemical elements having a lower mass number than chemical elements of the liquid material through at least one nozzle in a directed manner locally to at least one of: (1) the discharge space, and (2) the liquid material on a supply path to the discharge space, such that a density of the evaporated liquid material in the discharge space is reduced.

2. The method of claim 1, wherein said liquid material is evaporated by at least one laser pulse.

3. The method of claim 1, wherein said liquid material is a metal melt.

4. The method of claim 3, wherein said gas is oxygen.

5. The method of claim 4, wherein the oxygen gas is supplied to the liquid material so as to react with the liquid material and produce a metal oxide on the surface on which the liquid material is provided.

6. The method of claim 1, wherein said liquid material is supplied to the discharge space by at least one rotating wheel, and the at least one nozzle is arranged to supply said gas in a directed manner to a surface of the wheel which is covered with said liquid material.

7. The method of claim 1, wherein the liquid material is a tin melt.

8. The method of claim 1, further comprising supplying the gas through the at least one nozzle in a directed manner onto the surface on which the liquid material is provided at a region of the surface that is not located at the discharge space.

9. The method of claim 1, further comprising providing the at least one nozzle at a distance of no more than 10 mm from the surface on which the liquid material is provided.

10. An apparatus, comprising at least two electrodes arranged at a distance from one another to allow the generation of a plasma in a gaseous medium in a discharge space between said electrodes, a device for applying a liquid material to a surface in said discharge space and an energy beam device adapted to direct an energy beam (9) onto said surface evaporating said applied liquid material at least partially, thereby producing said gaseous medium, and at least one nozzle configured to supply a gas locally in a directed manner to at least one of: (1) the discharge space, and the liquid material on a supply path to the discharge space, such that a density of the evaporated liquid material in the discharge space is reduced.

11. The apparatus of claim 10, wherein said device for applying a liquid material is adapted to apply the liquid material to a surface of said electrodes.

12. The apparatus as claimed in claim 11, wherein said electrodes are rotatable wheels which can be made to rotate during operation.

13. The apparatus of claim 12, wherein said electrodes dip, while rotating, into containers containing the liquid material.

14. The apparatus of claim 10, further comprising a container of tin melt as the liquid material, and wherein the device for applying the liquid material to the surface obtains the liquid material from the container.

15. The apparatus of claim 10, wherein the at least one nozzle is configured to supply the gas in a directed manner onto the surface on which the liquid material is provided at a region of the surface that is not located at the discharge space.

16. The apparatus of claim 10, wherein the at least one nozzle is configured to supply the gas as oxygen gas to the liquid material so as to react with the liquid material and produce a metal oxide on the surface on which the liquid material is provided.

17. The apparatus of claim 10, wherein the at least one nozzle is disposed at a distance of no more than 10 mm from the surface on which the liquid material is provided.

* * * * *